US010309716B2

(12) United States Patent
Guo et al.

(10) Patent No.: US 10,309,716 B2
(45) Date of Patent: Jun. 4, 2019

(54) REFRIGERATOR

(71) Applicant: HISENSE RONSHEN (GUANGDONG) REFRIGERATOR CO., LTD, Foshan (CN)

(72) Inventors: Gang Guo, Foshan (CN); Meiyan Wang, Foshan (CN); Dong Kong, Foshan (CN); Qiang Liao, Foshan (CN); Xiaofen Long, Foshan (CN); Wen Zeng, Foshan (CN); Feiyue You, Foshan (CN)

(73) Assignee: HISENSE RONSHEN (GUANGDONG) REFRIGERATOR CO., LTD., Foshan (CN)

( * ) Notice: Subject to any disclaimer, the term of this patent is extended or adjusted under 35 U.S.C. 154(b) by 141 days.

(21) Appl. No.: 14/774,957

(22) Filed: Sep. 11, 2015

(65) Prior Publication Data

US 2017/0074578 A1 Mar. 16, 2017

Related U.S. Application Data

(63) Continuation of application No. PCT/CN2014/092970, filed on Dec. 3, 2014.

(30) Foreign Application Priority Data

Oct. 29, 2014 (CN) ..... 2014 1 0596661

(51) Int. Cl.
*F25D 23/04* (2006.01)
*F25C 1/24* (2018.01)
(Continued)

(52) U.S. Cl.
CPC ..... *F25D 23/04* (2013.01); *F25C 1/24* (2013.01); *F25C 5/22* (2018.01); *F25D 23/028* (2013.01);
(Continued)

(58) Field of Classification Search
CPC ..... F25C 1/24; F25C 5/005; F25C 2400/10; F25C 5/22; F25C 5/182; F25D 23/067;
(Continued)

(56) References Cited

U.S. PATENT DOCUMENTS 3,832,863 A * 9/1974 Boorman, Jr. ..... F25D 23/12 62/298
7,921,668 B2 * 4/2011 Lee ..... F25C 5/005 222/146.1
(Continued)

FOREIGN PATENT DOCUMENTS

CN 1598452 A 3/2005
CN 101074822 A 11/2007
(Continued)

OTHER PUBLICATIONS

International Search Report and Written Opinion for Application No. PCT/CN2014/092970 dated Jul. 28, 2015 (12 pages).
(Continued)

*Primary Examiner* — Emmanuel E Duke
(74) *Attorney, Agent, or Firm* — Dick, Billig & Czaja, PLLC

(57) ABSTRACT

A refrigerator includes a refrigerator door. An ice-making chamber is provided an inner wall of the refrigerator door. An ice-making chamber door is provided at an opening of the ice-making chamber. An ice-making machine is mounted on the inner side of the ice-making chamber door. When the ice-making chamber door is closed, the ice-making chamber door is able to cover the opening of the ice-making chamber and the ice-making machine is located within the ice-making chamber.

12 Claims, 4 Drawing Sheets

(51) Int. Cl.
*F25D 23/02* (2006.01)
*F25C 5/20* (2018.01)
*F25C 5/182* (2018.01)

(52) U.S. Cl.
CPC ..... *F25C 5/182* (2013.01); *F25C 2400/10* (2013.01); *F25D 2323/023* (2013.01)

(58) Field of Classification Search
CPC ... F25D 23/04; F25D 23/028; F25D 2323/023
See application file for complete search history.

(56) References Cited

U.S. PATENT DOCUMENTS

2007/0074527 A1* 4/2007 Lee ..... F25C 5/005 62/344
2010/0126185 A1* 5/2010 Cho ..... F25C 5/22 62/3.63
2010/0126201 A1 5/2010 Seo et al.
2011/0146324 A1* 6/2011 Lee ..... F25C 5/185 62/344
2011/0232317 A1 9/2011 Flores
2012/0291473 A1* 11/2012 Krause ..... F25C 5/005 62/340
2015/0135739 A1* 5/2015 Choo ..... F25C 5/02 62/66

FOREIGN PATENT DOCUMENTS

CN 102102930 A 3/2010
CN 102102930 A 6/2011
EP 1517103 A2 3/2005
EP 2320176 A1 5/2011
EP 2375200 A1 10/2011
EP 2339273 A3 12/2013
EP 2672206 A2 12/2013
WO 2013000979 A2 1/2013

OTHER PUBLICATIONS

European Search Report for EP Application No. 14885067.0 dated Dec. 8, 2016 (8 pages).

* cited by examiner

REFRIGERATOR

CROSS REFERENCE TO RELATED APPLICATIONS

This application claims the priority of Chinese Patent Application No. 201410596661.5, filed in the Patent Office of the People's Republic of China on Oct. 29, 2014 and entitled Refrigerator, which is hereby incorporated by reference herein in its entirety.

FIELD

The present disclosure relates to the technical field of refrigerator, in particular to a refrigerator.

BACKGROUND

With the improvement of people's living standard, high-grade refrigerators are more and more popular with consumers. Automatic ice-making machines are one of important symbols of high-grade refrigerators. Generally, all high-grade refrigerators of famous brands in China and abroad have automatic ice-making machines.

Referring to FIG. 1, taking a French refrigerator as example, an automatic ice-making machine includes an ice-making chamber 01, an ice-making chamber door 02 and a distributor (not shown), as well as an ice-making machine 03 and an ice storage box 04 both disposed on an inner wall of the ice-making chamber 01. Ice cubes made by the ice-making machine 03 enter the ice storage box 04 through an ice discharge channel, and the ice cubes in the ice storage box 04 are discharged outside the refrigerator through the distributor for use.

As the ice-making machine 03 and the ice storage box 04 are mounted up-down on the inner wall of the ice-making chamber 01, a space surrounding the ice-making machine 03 is limited, which causes the inconvenience of cleaning and maintenance.

SUMMARY

In one embodiment of the present disclosure provides a refrigerator. A refrigerator comprises a refrigerator door, wherein an ice-making chamber is provided on an inner wall of the refrigerator door, an ice-making chamber door is provided at the opening of the ice-making chamber, and an ice-making machine is mounted on the inner side of the ice-making chamber door; when the ice-making chamber door is closed, the ice-making chamber door is able to cover the opening of the ice-making chamber, and the ice-making machine is located within the ice-making chamber.

BRIEF DESCRIPTION OF THE DRAWINGS

To more clearly describe the technical solution in the embodiment of the present disclosure or in the prior art, accompanying drawings to be used in the description of the embodiments or of the prior art will be briefly described. Apparently, the accompanying drawings in the following description are merely some embodiments of the present disclosure, and a person of ordinary skill in the art may further obtain other drawings according to these drawings without any creative labor.

DETAILED DESCRIPTION

The technical solution of the present disclosure will be clearly and completely described below referring to the accompanying drawings in the embodiment of the present disclosure. Apparently, the embodiment described herein is merely a part but not all of embodiments. All other embodiments obtained by a person of ordinary skill in the art based on the embodiment of the present disclosure without any creative labor shall fall into the protection scope of the present disclosure.

In the description of the present disclosure, it should be understood that the orientation or position relationship indicated by terms such as "center", "up", "down", "front", "rear", "left", "right", "vertical", "horizontal", "top", "bottom", "inner" and "outer" is an orientation or position relationship shown based on the accompanying drawings, and is merely used for conveniently describing the present disclosure and simplifying the description, rather than indicating or implying that the device or element must have a particular orientation or must be constructed and operated in a particular orientation. Therefore, the terms shall not be regarded as limiting the present disclosure.

Figure 1:
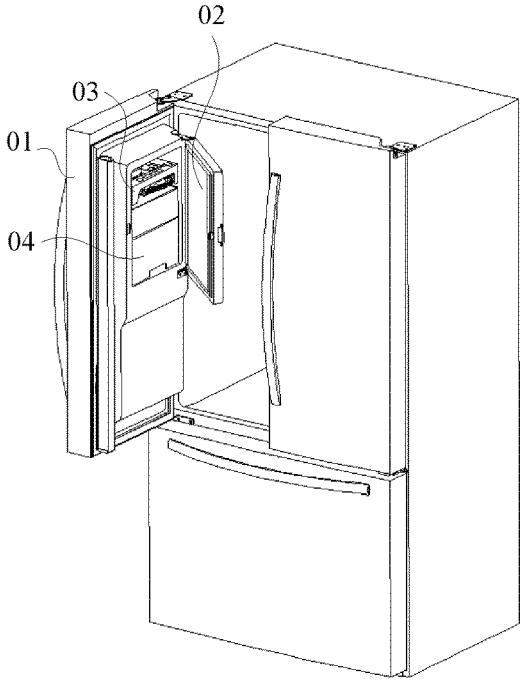
FIG. 1 is a structural diagram of a refrigerator in the prior art.
Figure 2:
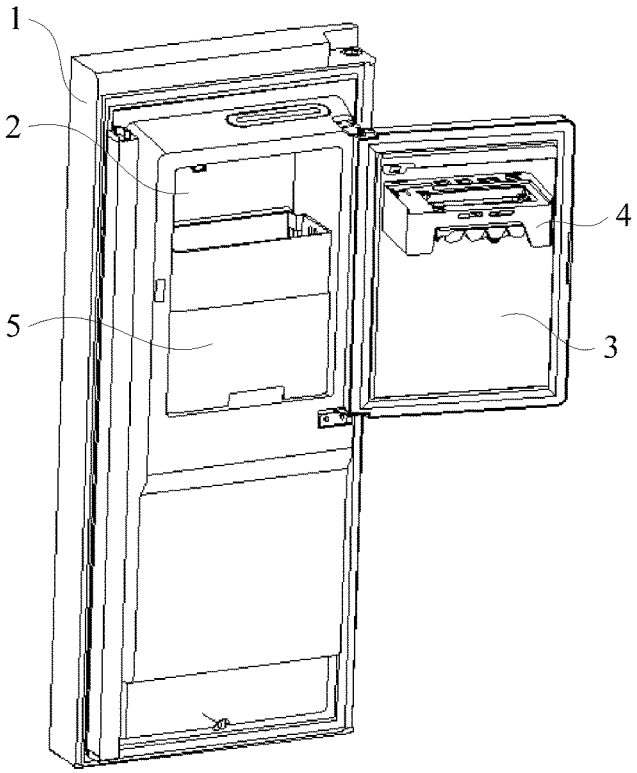
FIG. 2 is a structural diagram of a refrigerator according to an embodiment of the present disclosure.

FIG. 2 is a specific embodiment of a refrigerator according to the embodiment of the present disclosure. The refrigerator in this embodiment includes a refrigerator door 1, wherein an ice-making chamber 2 is provided on the inner wall of the refrigerator door 1, an ice-making chamber door 3 is provided at the opening of the ice-making chamber 2, and an ice-making machine 4 is mounted on an inner side of the ice-making chamber door 3; when the ice-making chamber door 3 is closed, the ice-making chamber door 3 is able to cover the opening of the ice-making chamber 2, and the ice-making machine 4 is located within the ice-making chamber 2.

With regard to the refrigerator provided by the embodiment of the present disclosure, as the ice-making machine 4 is disposed on the ice-making chamber door 3, when the ice-making chamber door 3 is closed, the ice-making machine 4 may work normally. For the mounting and maintenance of the ice-making machine, as an ice storage box is provided below the ice-making machine 4 in the prior art and due to the occlusion of the ice-making chamber wall on the left, right and upper sides, the space available for operating is small. In contrast, since the ice-making machine 4 provided by the embodiment of the present disclosure is mounted on the ice-making chamber door 3, during mounting and maintenance, there is basically no occlusion surrounding the ice-making machine 4 when the ice-making chamber door 3 is opened, so that the space available for operating is large. Therefore, the arrangement of the ice-making machine 4 on the ice-making chamber door 3 is convenient not only for the mounting and maintenance of the ice-making machine 4, but also for a user to clean the ice-making machine 4.

For ease of storage of ice cubes made by the ice-making machine 4, an ice storage box 5 is provided within the ice-making chamber 2. When the ice-making chamber door 3 is closed, the ice-making machine 4 is located above the ice storage box 5. In addition, an ice cube tray (not shown) is further provided within the ice-making machine 4. When it needs to make ice, the ice-making chamber door 3 is closed, a proper amount of water is fed into the ice cube tray of the ice-making machine 4, and the produced ice cubes are stored in the ice cube tray. At this moment, the ice-making machine 4 may turn over and twist the ice cube tray, so that the produced ice cubes may smoothly fall into the ice storage box 5 for storage.

Figure 3:
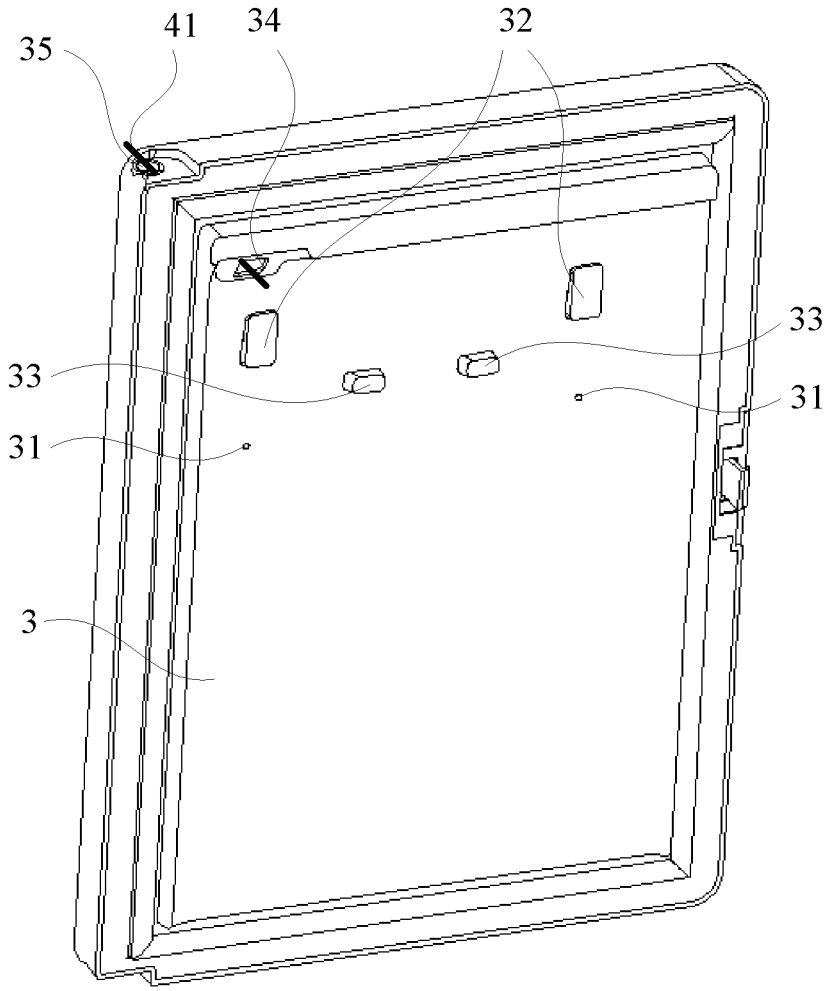
FIG. 3 is a structural diagram of an ice-making chamber door of the refrigerator according to the embodiment of the present disclosure.
Figure 4:
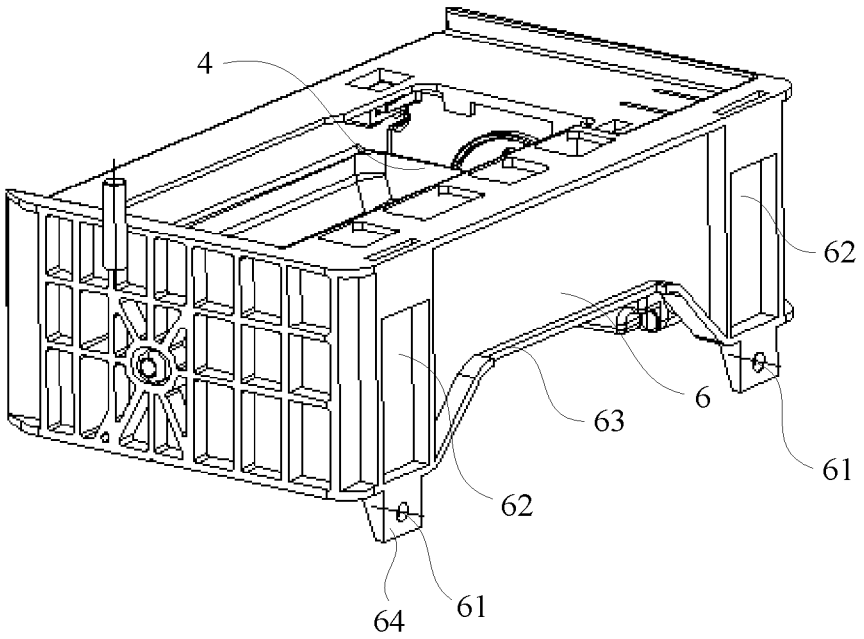
FIG. 4 is a structural diagram of an ice-making machine and an ice-making machine holder of the refrigerator according to the embodiment of the present disclosure.

Referring to FIG. 3 and FIG. 4, to secure the ice-making machine 4 on the ice-making chamber door 3, an ice-making machine holder 6 is provided, and the ice-making machine 4 is secured on the ice-making machine holder 6. Then, the ice-making machine holder 6 is connected to the ice-making chamber door 3 by connecting screws. Threaded holes 31 are formed on a surface of the ice-making chamber door 3 close to the ice-making chamber 2, and via holes 61 are formed through a surface of the ice-making machine holder 6 close to the ice-making chamber door 3. To be convenient for the connecting screws to secure the threaded holes 31 and the via holes 61, a connecting lug 64 is provided on the ice-making machine holder 6, so that the via holes 61 are formed through the connecting lug 64. When the connecting screws are in fit connection to the threaded holes 31 after passing through the via holes 61, the connecting screws need to be screwed by a screwdriver. As the connecting lug 64 is protruded from the ice-making machine holder 6, a certain space may be provided for operating the screwdriver, so that it is convenient to screw the connecting screws and thus secure the ice-making machine holder 6 and the ice-making machine 4 onto the ice-making chamber door 3.

To avoid the instability of the ice-making machine 4 due to gravity, positioning projections 32 are provided on the surface of the ice-making chamber door 3 close to the ice-making chamber 2, positioning grooves 62 are provided on the ice-making machine holder 6, and the positioning projections 32 are cooperatively disposed in the positioning grooves 62. The positioning projections and the positioning grooves may be provided below the threaded holes and the via holes, respectively, and in this case, the connecting lug needs to be disposed above the ice-making machine holder. Therefore, a certain space for the connecting lug needs to be reserved between the ice-making machine holder and an upper frame of the ice-making chamber door. Equivalently, the ice-making machine holder is moved down, and correspondingly, the ice storage box also needs to be moved down. Accordingly, the ice-making machine needs to be larger, and the structural strength of the refrigerator door 1 will be thus reduced. As shown in FIG. 3 and FIG. 4, preferably, the positioning projections 32 and the positioning grooves 62 are located above the threaded holes 31 and the via holes 61, respectively, and in this case, the connecting lug is located below the ice-making machine holder 6. When the ice-making chamber door 3 is closed, the connecting lug may be overlapped with a portion of the ice storage box 5 close to the ice-making chamber door 3, so that the connecting lug is prevented from occupying an unnecessary space. After the positioning projection 32 is fitted in the positioning grooves 62, the positioning projection 32 mainly functions as supporting the ice-making machine 4 and the ice-making machine holder 6 in a vertical direction, so that the stability of the ice-making machine 4 is ensured.

To ensure the balance and stability of the ice-making machine 4, there are two positioning grooves 62 and two via holes 61, respectively, and the two positioning grooves 62 and the two via holes 61 are distributed at four corners of the surface of the ice-making machine holder 6 close to the ice-making chamber door; correspondingly, two positioning projections 32 and two threaded holes 31 are distributed at corresponding positions on the ice-making chamber door 3 to secure the ice-making machine holder 6 and the ice-making chamber door 3 and further ensure the connection stability of the ice-making machine holder 6, so that the connection stability of the ice-making machine 4 is ensured.

To avoid the instability of the ice-making machine 4 due to too heavy ice cubes in the ice-making machine 4, a support projection 33 is further provided on the surface of the ice-making chamber door 3 close to the ice-making chamber 2, a rack brim 63 is provided on the ice-making machine holder 6, and the rack brim 63 is cooperatively attached to the support projection 33. To better secure the ice-making machine 4, the rack brim 63 is provided at a position corresponding to the ice cube tray in the ice-making machine 4. During the operation of the ice-making machine 4, when the ice cube tray is relatively heavy with ice cubes therein, the support projection 33 may provide a support force for the ice-making machine 4 at the position corresponding to the ice cube tray, so that the stability of the ice-making machine 4 during the operation is maintained.

For ease of the connection between a connecting wire 41 of the ice-making machine 4 and a main control panel of the refrigerator, a wire hole 34 and a hinge hole 35 which are communicated with each other are formed through the ice-making chamber door 3, and the connecting wire 41 of the ice-making machine 4 may successively pass through the wire hole 34 and hinge hole 35, then pass through the refrigerator door 1 and get out from a door hinge hole of the refrigerator door 1, and finally penetrate into a refrigerator body to connect the main control panel of the refrigerator.

In addition, the water source of the ice-making machine 4 is generally tap water. One end of a water supply pipe is connected to the water source, while the other end thereof passes through the refrigerator body, then passes through the door hinge hole of the refrigerator door 1 and finally penetrates into the refrigerator door 1 to connect a water feeding pipe of the ice-making chamber. When the ice-making chamber door is closed, a water valve is opened, and water flowing into the water supply pipe may be fed into the ice cube tray through the water feeding pipe of the ice-making chamber. Such an arrangement of a circuit and a water path may avoid the exposure of the wire and the water pipe, so that both the safety and aesthetic appearance of the automatic ice-making machine are improved.

Figure 5:
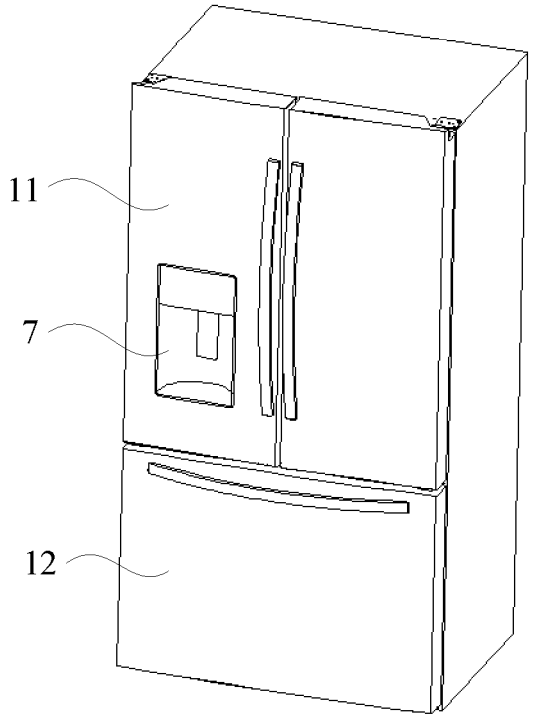
FIG. 5 is an externally structural diagram of the refrigerator according to the embodiment of the present disclosure.

Referring to FIG. 2 and FIG. 5, to conveniently take ice cubes out, a distributor 7 in communication with the ice storage box 5 through an ice discharge channel is provided on an outer wall of the refrigerator door 1, and ice cubes in the ice storage box 5 may be discharged through the distributor 7. Thus, without opening the refrigerator door 1, the produced ice cubes may be taken out, so that the unnecessary loss of refrigerating capacity due to the frequent opening of the refrigerator door 1 is avoided.

Figure 6:
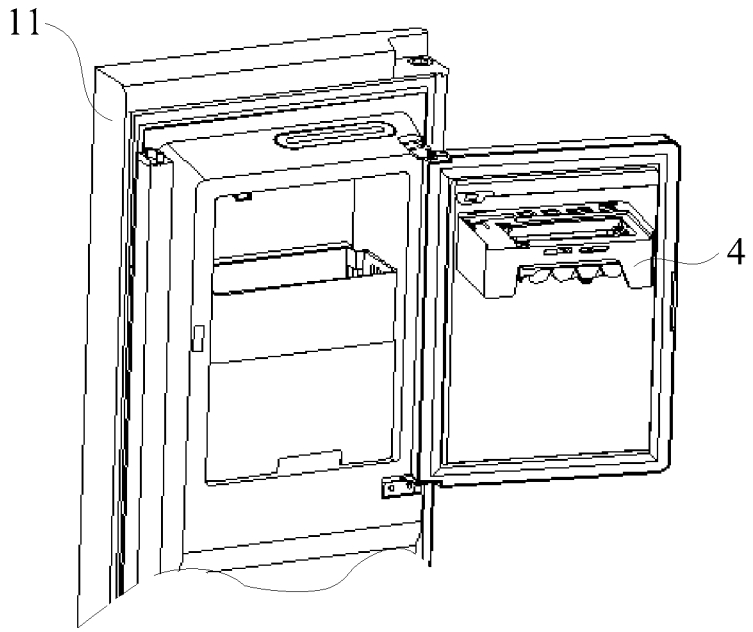
FIG. 6 is an internally structural diagram of a portion of the refrigerator according to the embodiment of the present disclosure.

Referring to FIG. 5 and FIG. 6, the refrigerator door 1 includes a refrigerating chamber door 11 and a freezing chamber door 12. As a freezing chamber is located at a lower part of the refrigerator, the operation and use of the user will be influenced if the ice-making machine is disposed on the freezing chamber door 12. Therefore, the ice-making machine 4 is preferably disposed on an inner wall of the refrigerating chamber door 11.

With regard to the refrigerator provided by embodiment of the present disclosure, as the ice-making machine is disposed on the ice-making chamber door, when the ice-making chamber door is closed, the ice-making machine may work normally. For the mounting and maintenance of the ice-making machine, as an ice storage box is provided below the ice-making machine in the prior art, and due to the occlusion of the ice-making chamber wall on the left, right and upper sides, the space available for operating is small. In contrast, since the ice-making machine provided by the embodiment of the present disclosure is mounted on the ice-making chamber door, during mounting and maintenance, there is basically no occlusion surrounding the ice-making machine when the ice-making chamber door is opened, so that the space available for operating is large. Therefore, the arrangement of the ice-making machine on the ice-making chamber door is convenient not only for the mounting and maintenance of the ice-making machine, but also for a user to clean the ice-making machine.

The foregoing description merely shows specific implementations of the present disclosure, and the protection scope of the present disclosure is not limited thereto. Any variations or replacements that may be readily obtained by those skilled in the art within the technical scope disclosed in the present disclosure shall fall into the protection scope of the present disclosure. Therefore, the protection scope of the present disclosure shall be subject to the protection scope defined by the claims.

The invention claimed is:

1. A refrigerator, comprising a refrigerator door, wherein an ice-making chamber is provided on an inner wall of the refrigerator door, an ice storage box is provided within the ice-making chamber, an ice-making chamber door is provided at an opening of the ice-making chamber, and an ice-making machine is mounted on the inner side of the ice-making chamber door;

wherein, the ice-making machine is configured to be located within the ice-making chamber above the ice storage box when the ice-making chamber door is closed, and wherein the ice-making machine is configured to move away from the ice storage box when the ice-making chamber door is opened, and wherein the ice-making machine is secured on an ice-making machine holder which is connected to the ice-making chamber door, a support projection is provided on a surface of the ice-making chamber door close to the ice-making chamber, a rack brim is provided at a bottom edge of a surface of the ice-making machine holder facing the ice-making chamber door and protrudes from the surface of the ice-making machine holder in a direction perpendicular to the surface of the ice-making machine holder, a bottom surface of the rack brim extends along the bottom edge of the surface of the ice-making machine holder and the direction perpendicular to the surface of the ice-making machine holder, and the support projection is beneath the bottom surface of the rack brim so as to support the rack brim.

2. The refrigerator according to claim 1, wherein the ice-making machine holder is connected to the ice-making chamber door by a plurality of connecting screws; a plurality of threaded holes are formed through the surface of the ice-making chamber door close to the ice-making chamber, a plurality of via holes are formed through the surface of the ice-making machine holder close to the ice-making chamber door, and each of the plurality of connecting screws is in fit connection to a corresponding one of the plurality of threaded holes after passing through a corresponding one of the plurality of via holes.

3. The refrigerator according to claim 2, wherein a plurality of positioning projections are provided on the surface of the ice-making chamber door close to the ice-making chamber, a plurality of positioning grooves are provided on the ice-making machine holder, and each of the plurality of positioning projections is cooperatively disposed in a corresponding one of the plurality of positioning grooves.

4. The refrigerator according to claim 3, wherein a plurality of connecting lugs are provided on the ice-making machine holder, and each of the plurality of via holes is formed through a corresponding one of the plurality of connecting lugs.

5. The refrigerator according to claim 4, wherein the plurality of positioning projections are located above the plurality of threaded holes, respectively and the plurality of positioning grooves are located above the plurality of via holes, respectively.

6. The refrigerator according to claim 3, wherein the plurality of positioning grooves comprise two positioning grooves, the plurality of via holes comprise two via holes, and the two positioning grooves and the two via holes are distributed at four corners of the surface of the ice-making machine holder close to the ice-making chamber door.

7. The refrigerator according to claim 1, wherein a wire hole and a hinge hole which are communicated with each other are formed through the ice-making chamber door, and a connecting wire of the ice-making machine successively passes through the wire hole and hinge hole.

8. The refrigerator according to claim 1, wherein the refrigerator door comprises a refrigerating chamber door and a freezing chamber door, and the ice-making machine is disposed on an inner wall of the refrigerating chamber door.

9. The refrigerator according to claim 1, wherein the rack brim is provided at an entire bottom edge of the surface of the ice-making machine holder facing the ice-making chamber door.

10. The refrigerator according to claim 1, wherein the ice-making machine includes an ice cube tray, and the rack brim is provided at a position corresponding to the ice cube tray.

11. The refrigerator according to claim 1, wherein the bottom edge of the ice-making machine holder provided with the rack brim has a trapezoid shape, and an interval between the bottom edge of the ice-making machine holder and an opposite edge of the ice-making machine holder is reduced from two ends of the bottom edge of the ice-making machine holder to a middle of the bottom edge of the ice-making machine holder.

12. The refrigerator according to claim 11, wherein the support projection is provided at a position corresponding to an upper line of the trapezoid shape.

* * * * *